US011852996B1

(12) United States Patent
Bachar et al.

(10) Patent No.: US 11,852,996 B1
(45) Date of Patent: Dec. 26, 2023

(54) UNCHARGED INK SUPPLY FOR ELECTRICAL FATIGUE IN LIQUID ELECTROPHOTOGRAPHY PRINTING

(71) Applicant: Hewlett-Packard Development Company, L.P., Spring, TX (US)

(72) Inventors: Eyal Bachar, Nes Ziona (IL); Gil Bar-Haim, Nes Ziona (IL); Albert Teishev, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 18/049,147

(22) Filed: Oct. 24, 2022

(51) Int. Cl.
*G03G 15/00* (2006.01)
*G03G 15/10* (2006.01)

(52) U.S. Cl.
CPC ..... *G03G 15/5025* (2013.01); *G03G 15/10* (2013.01)

(58) Field of Classification Search
CPC ..... G03G 15/10; G03G 15/5025
USPC ..... 399/75, 237
See application file for complete search history.

(56) References Cited

U.S. PATENT DOCUMENTS 9,037,046 B2 * 5/2015 Bachar ..... G03G 21/0094 399/237

FOREIGN PATENT DOCUMENTS

JP 2012163583 * 8/2012

* cited by examiner

*Primary Examiner* — Hoan H Tran

(57) ABSTRACT

Systems, apparatuses, and methods of fluid delivery for liquid electrophotography printing. A fluid delivery apparatus includes a charged ink source, a supplemental fluid source, a working suspension tank in fluid communication with the charged ink source and the supplemental fluid source, a sensor, and an optical density control unit. The charged ink source is to store a charged ink mixture including charge directors and toner particles. The supplemental fluid source is to store a supplemental fluid including imaging oil. The working suspension tank is to store a working suspension mixture including the charge directors, the toner particles, and the imaging oil. The sensor is to monitor an optical density of print output of the liquid electrophotography printing apparatus. The optical density control unit is to determine whether to supply an uncharged ink mixture to the working suspension tank in response to the monitored optical density indicating electrical fatigue.

20 Claims, 5 Drawing Sheets

UNCHARGED INK SUPPLY FOR ELECTRICAL FATIGUE IN LIQUID ELECTROPHOTOGRAPHY PRINTING

BACKGROUND

Liquid electrophotography printing typically includes providing fluid (e.g., such as liquid toner) to fluid applicators (e.g., such as binary ink developers). The fluid applicators provide charged liquid toner to a latent image on a photoconductive member to form fluid images. The photoconductive member transfers the fluid images onto an image transfer member and/or some other substrate. In liquid electrophotography printing, the liquid toner typically includes charge directors to electrically charge the liquid toner.

BRIEF DESCRIPTION OF THE DRAWINGS

Various examples will be described below by referencing the following drawings, in which.

DETAILED DESCRIPTION

Liquid electrophotography printing systems suffer from electrical fatigue under certain conditions. Under such electrical fatigue conditions, optical density of some inks may become unsatisfactory.

For example, a working suspension for liquid electrophotography printing is typically formed from mixing a charged ink (e.g., with charge directors and toner) to imaging oil. Once the working suspension is fatigued, adjustments to voltage applied to ink applicators (e.g., such as binary ink developers (BIDS)) may be performed to increase the optical density. However, the electrical fatigue may continue to worsen to the point where further voltage adjustments to the ink applicators is no longer effective.

As will be discussed in greater detail below, some implementations described herein address electrical fatigue in liquid electrophotography printing. For example, systems, apparatuses, and methods of fluid delivery for liquid electrophotography printing are described below. For example, a fluid delivery apparatus includes a charged ink source, a supplemental fluid source, a working suspension tank in fluid communication with the charged ink source and the supplemental fluid source, a sensor, and an optical density control unit. The charged ink source is to store a charged ink mixture comprising charge directors and toner particles. The supplemental fluid source is to store a supplemental fluid comprising imaging oil. The working suspension tank is to store a working suspension mixture comprising the charge directors, the toner particles, and the imaging oil. The sensor is to monitor an optical density of print output of the liquid electrophotography printing apparatus. The optical density control unit is to determine whether to supply an uncharged ink mixture to the working suspension tank in response to the monitored optical density indicating electrical fatigue.

Figure 1:
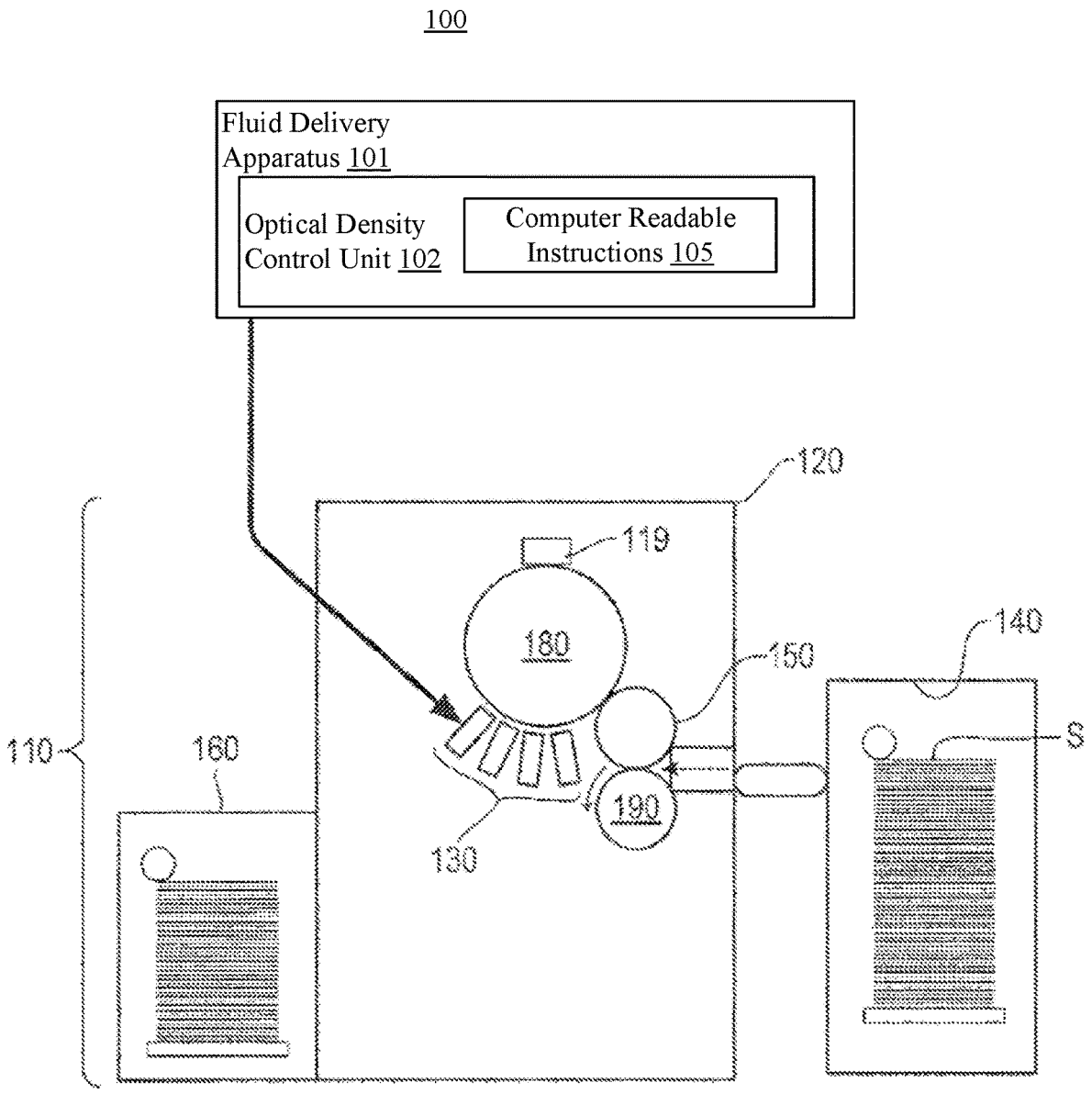
FIG. 1 is a schematic view illustrating a printing system including a liquid electrophotography printing apparatus and a fluid delivery apparatus according to an example.

FIG. 1 is a schematic view illustrating a printing system 100 including a liquid electrophotography printing apparatus (LEP) 110 and a fluid delivery apparatus 101 according to an example. In the illustrated example, the fluid delivery apparatus 101 is in communication with a printing apparatus, such as the liquid electrophotography printing apparatus 110.

The illustrated example is described relative to liquid electrophotography printing. As used herein the term "liquid electrophotography printing" refers to any printing machine or method that utilizes a mixture of charge directors and ink to transfer ink to a substrate utilizing an electrostatic charge.

In some examples, the liquid electrophotography printing apparatus 110 may include an image forming unit 120 that receives a substrate S, such as a print media, from an input unit 140 and outputs the substrate S to an output unit 160. The image forming unit 120 may include a photo imaging member (PIP) 180 that defines an outer surface on which images can be formed. The outer surface may be charged with a suitable charger (not illustrated), such as a charge roller, and portions of the outer surface that correspond to features of the image can be selectively discharged by a laser writing unit 119 to form an electrostatic image on the outer surface.

In operation, the fluid delivery apparatus 101 may supply fluid, such as charged liquid toner (e.g., ELECTROINK), to fluid applicators 130 of the liquid electrophotography printing apparatus 110. For example, the fluid applicators 130 may be implemented as fluid development units, binary ink developers (BIDs), the like, and/or combinations thereof. Such fluid applicators 130 may apply the fluid to the electrostatic image to form a fluid image on the cuter surface of the photo imaging member (PIP) 180 to be transferred to an intermediate transfer member (ITM) 150. The ITM 150 may be configured to receive the fluid image from the PIP 180, heat the image, and transfer the image to the substrate S. During the transfer from the ITM 150 to the substrate S, the substrate S may be pinched between the ITM 150 and an impression member 190. Once the fluid image has been transferred to the substrate S, the substrate S can be transported to the output unit 160.

In some implementations, an optical density control unit 102, which may include computer readable instructions 105 (e.g., software, firmware, hardware, the like, and/or combinations thereof), may be associated with the fluid delivery apparatus 101. Additionally, or alternatively, all or portions of the computer readable instructions 105 of optical density control unit 102 may be associated with another computing device (e.g., a mobile device). The operations of the computer readable instructions 105 of optical density control unit 102 will be described in greater detail below.

Electrical fatigue (ELF) in liquid electrophotography printing typically appears in any color, but is often seen especially in cyan, black, magenta, and/or the like. Often, such electrical fatigue happens when a customer prints jobs with low coverage mono color, which can result in an abrupt optical density decline. This decline is typically due to a rise in ink particle conductivity when the ink is exposed continuously to an elevated electric field until a top of a voltage working window for fluid applicators 130.

For example, once voltages of fluid applicators 130 are calibrated, an optical density decline may be observed within dozens of impressions. If the voltages of fluid applicators 130 is recalibrated to higher voltages, the optical density may temporarily be retained; however, an optical density decline may again be observed within dozens of impressions after the recalibration to a higher voltage. At some point, no further voltage increase is possible to address the optical density decline.

As will be described in greater detail below, some implementations described herein address electrical fatigue by adding uncharged ink to the existing working suspension in response to sensing low optical density. For example, in some examples, a refreshment of uncharged ink may be added to a fatigued working solution that includes charged ink during printing. In some examples, such uncharged ink may be added in response to a decline in optical density. For example, such uncharged ink may be added from a dedicated container and/or reservoir. Such a refreshment of uncharged ink to the fatigued working solution that includes charged ink is thought to stabilize the charging of the working solution and address the decline in optical density. Accordingly, some examples described herein may be implemented to avoid electrical fatigue in liquid electrophotography printing, such as during continuous printing of low coverage mono color, for example.

Additional and/or alternative operations for printing system 100 are described in greater detail below in the description of printing system 200 of FIG. 2.

Figure 2:
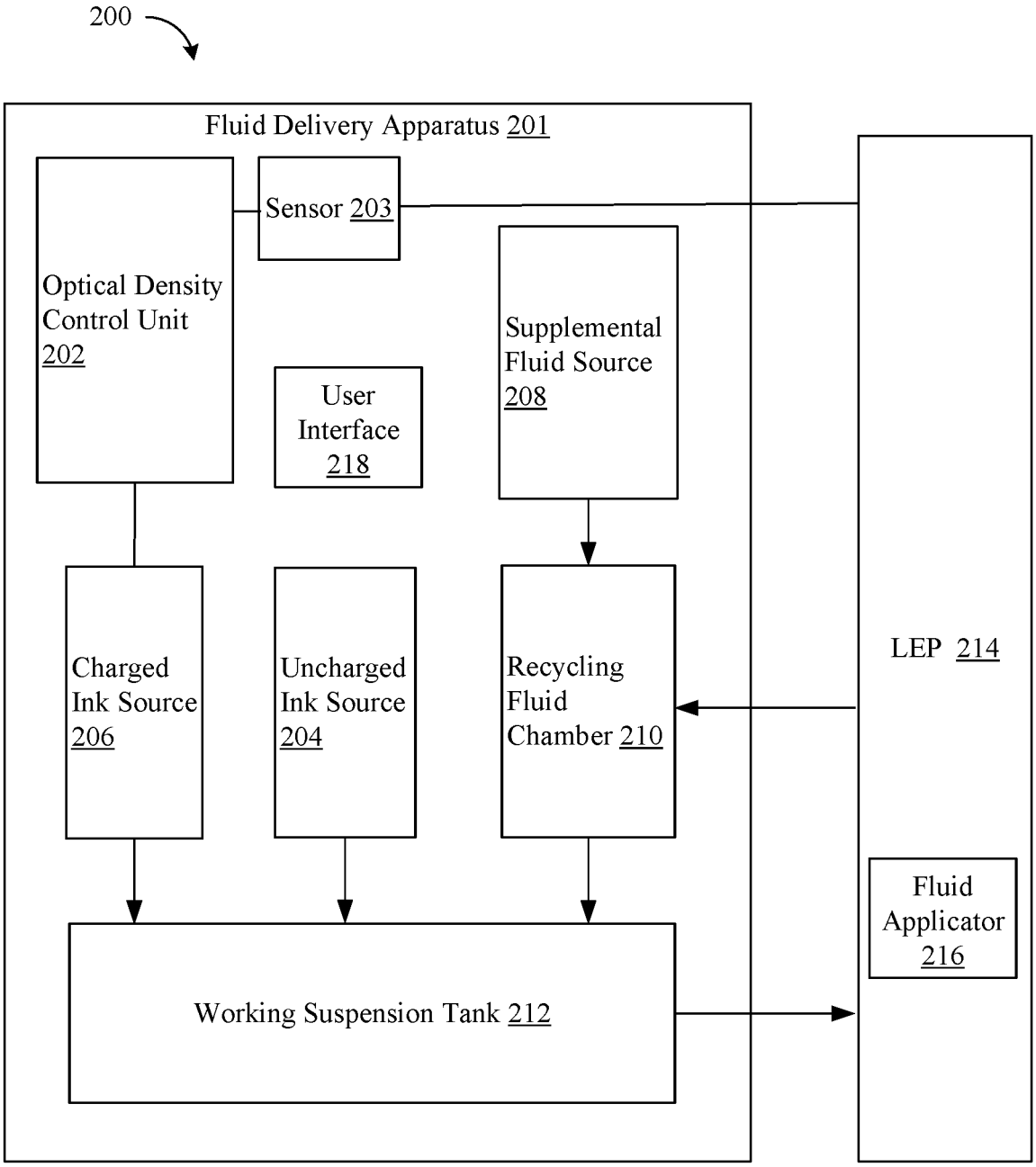
FIG. 2 is a block diagram illustrating another printing system including a liquid electrophotography printing apparatus and a fluid delivery apparatus according to an example.

FIG. 2 is a block diagram illustrating another printing system 200 including a liquid electrophotography printing apparatus 214 and a fluid delivery apparatus 201 according to an example. In the illustrated example, the fluid delivery apparatus 201 may be operatively associated with the liquid electrophotography printing apparatus 214. In some examples, the liquid electrophotography printing apparatus 214 may include a fluid applicator 216.

In some examples, the fluid delivery apparatus 201 may include a charged ink source 206, a supplemental fluid source 208, a working suspension tank 212, a sensor 203, an optical density control unit 202, an uncharged ink source 204, a recycling fluid chamber 210, a user interface 218, the like, and/or combinations thereof.

In some implementations, the charged ink source 206 may store a charged ink mixture. Such a charged ink mixture may include charge directors, toner particles, the like, and/or combinations thereof.

In some examples, the supplemental fluid source 208 may store a supplemental fluid. Such a supplemental fluid may include imaging oil and/or the like.

In some implementations, the working suspension tank 212 may be in fluid communication with the charged ink source 206 and/or the supplemental fluid source 208. For example, the working suspension tank 212 may store a working suspension mixture. Such a working suspension mixture may include the charge directors, the toner particles, the imaging oil, the like, and/or combinations thereof.

In some examples, the sensor 203 may monitor an optical density of print output of the liquid electrophotography printing apparatus 214.

In some implementations, the optical density control unit 202 may determine whether to supply an uncharged ink mixture to the working suspension tank 212 in response to the monitored optical density from the sensor 203 indicating electrical fatigue of a print job being performed at the liquid electrophotography printing apparatus 214. Additionally, or alternatively, the optical density control unit 202 may determine whether the monitored optical density indicates an electrical fatigue, and to cause a supply of an uncharged ink mixture to the working suspension tank in response to the monitored optical density indicating electrical fatigue In some examples, the uncharged ink source 204 may be fluid communication with the working suspension tank 212. For example, the uncharged ink source 204 may store the uncharged ink mixture. Such an uncharged ink mixture may include additional toner particles free of association with additional charge directors and/or the like.

In some implementations, the recycling fluid chamber 210 may receive a used working suspension from the liquid electrophotography printing apparatus 214, receive the supplemental fluid from the supplemental fluid source 208, and pass a mixture of the used working suspension and the supplemental fluid to the working suspension tank 212.

In some examples, the optical density control unit 202 may trigger an automated release of the uncharged ink mixture from the uncharged ink source 204 in response to a determination to supply an uncharged ink mixture to the working suspension tank 212. Additionally, or alternatively, the optical density control unit 202 may trigger an automated release of the uncharged ink mixture from the uncharged ink source 204 in response to the monitored optical density indicating electrical fatigue. In some examples, the optical density control unit 202 may determine an amount of the automated release of the uncharged ink mixture from the uncharged ink source 204 in response to the monitored optical density.

Additionally, or alternatively, the optical density control unit 202 may determine whether to adjust a voltage to the fluid applicator 216 of the liquid electrophotography printing apparatus 214 in response to the monitored optical density. In some implementations, the optical density control unit 202 may trigger the automated release of the uncharged ink mixture in response to a determination that a further adjustment to increase the voltage to the fluid applicator 214 is not available.

In some examples, the optical density control unit 202 may trigger a notification to a user in response to a determination to supply an uncharged ink mixture to the working suspension tank 212. Additionally, or alternatively, the optical density control unit 202 may trigger a notification to a user in response to a determination to supply an uncharged ink mixture to the working suspension tank 212 in response to the monitored optical density indicating electrical fatigue. For example, such a notification may be displayed via the user interface 218. Such a user interface 218 may be implemented as a stationary or mobile terminal such as a computer or monitor associated with the optical density control unit 202 via a wired or wireless connection.

In operation, some implementations discussed herein may improve the quality of a print job performed using liquid electrophotography printing. Liquid electrophotography printing may suffer from electrical fatigue under certain conditions. Under such electrical fatigue conditions, optical density of some inks may become unsatisfactory.

In liquid electrophotography printing, a working suspension may be formed from mixing a charged ink (e.g., with charge directors and toner) to imaging oil. Once the working suspension is fatigued, one solution adjusts the voltage to fluid applicators (e.g., such as binary ink developers (BIDS)) to increase the optical density. However, the electrical fatigue is often able to continue to worsen to the point where further voltage adjustments to the fluid applicators is no longer effective.

Some implementations discussed herein may overcome these drawbacks by adding uncharged ink to the working suspension in response to sensing low optical density. For example, a continuous replacement of a fresh uncharged ink suspension (e.g., also referred to herein as uncharged ink mixture) may be performed. The addition of such a fresh uncharged ink to the working suspension may suppress ink particle conductivity back to an initial state, which allows a printing cycle within the initial press conditions without electrical fatigue.

In some examples, such an automatic partial refreshment of the working suspension (WS) with the uncharged ink mixture may be based on job coverage (e.g., based on sensed optical density). For example, in response to changes in the sensed optical density, the optical density control unit 102 of the fluid delivery apparatus 101 may automatically refresh the ink suspension of the working suspension (WS) with the uncharged ink mixture. In some examples, the optical density control unit 102 may calculate the frequency and/or amount of uncharged ink mixture to add to and/or replace the working suspension (WS). Additionally, or alternatively, in response to changes in the sensed optical density, the optical density control unit 102 of the fluid delivery apparatus 101 may utilized a predetermined frequency and/or amount of uncharged ink mixture to add to and/or replace the working suspension (WS). For example, computer readable instructions 105 may be implemented via the optical density control unit 102 of the fluid delivery apparatus 101.

In some implementations, an internal reservoir with an uncharged working suspension may be used to refresh the working suspension (WS). Additionally, or alternatively, in some implementations, a dedicated uncharged ink can or uncharged ink tube may be used to refresh the working suspension (WS). In such an example, the optical density control unit 102 of the fluid delivery apparatus 101 may add a predetermined ratio of imaging oil that is proportional to the added uncharged ink mixture. For example, a user may be prompted to add such a dedicated uncharged ink can or uncharged ink tube by a displayed indication of falling optical density via a user interface. Additionally, or alternatively, the fluid delivery apparatus 101 may build up spare uncharged working suspension prior to the start of a print run (e.g., at a press ramp up) that may be used to refresh the working suspension (WS).

Figure 3:
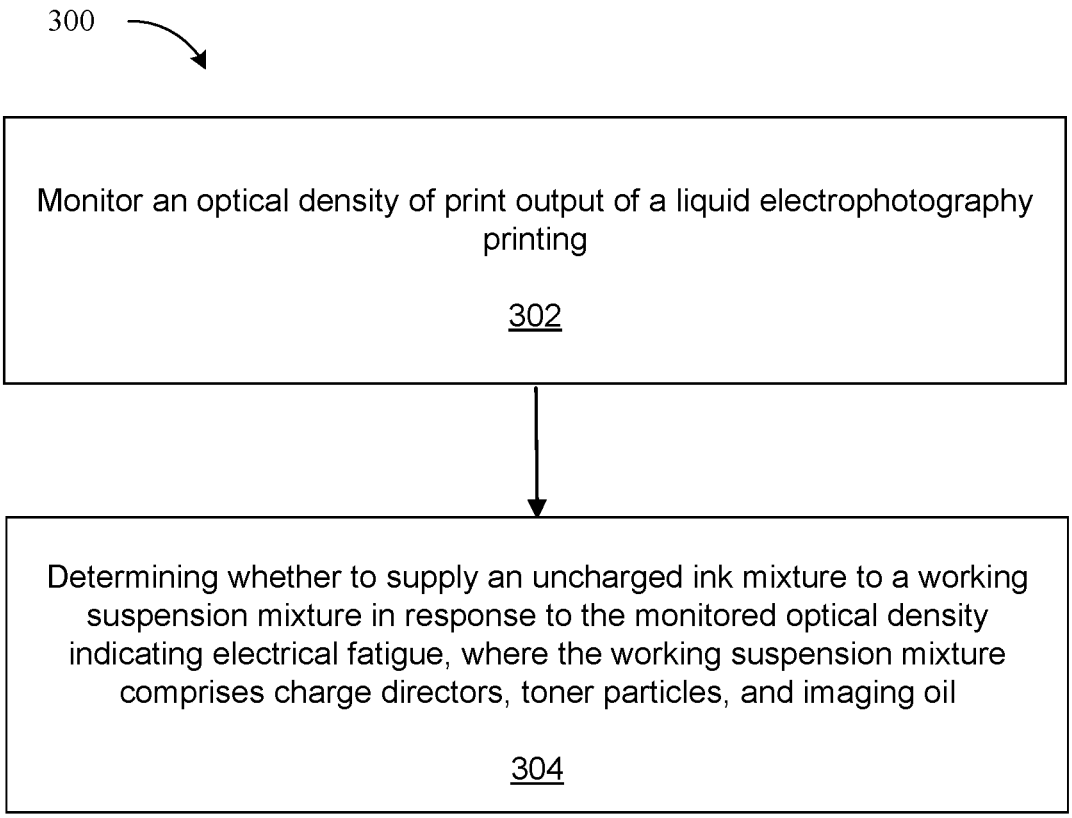
FIG. 3 is an illustration of a flowchart of an example method for fluid delivery for liquid electrophotography printing according to an example.

FIG. 3 shows an example method 300 for fluid delivery for liquid electrophotography printing according to an example. The method 300 may generally be implemented in a fluid delivery apparatus, such as, for example, the fluid delivery apparatus 101 (FIG. 1) and/or the fluid delivery apparatus 201 (FIG. 2), already discussed.

Illustrated processing block 302 provides for monitoring an optical density. For example, an optical density of print output of the liquid electrophotography printing may be monitored.

Illustrated processing block 304 provides for determining whether to supply an uncharged ink mixture to a working suspension mixture.

For example, a determination may be made as to whether to supply an uncharged ink mixture to a working suspension mixture to a working suspension mixture in response to the monitored optical density indicating electrical fatigue.

In some implementations, the working suspension mixture comprises charge directors, toner particles, imaging oil, the like, and/or combinations thereof.

Additional and/or alternative operations for method 300 are described in greater detail below in the description of FIG. 4.

Figure 4:
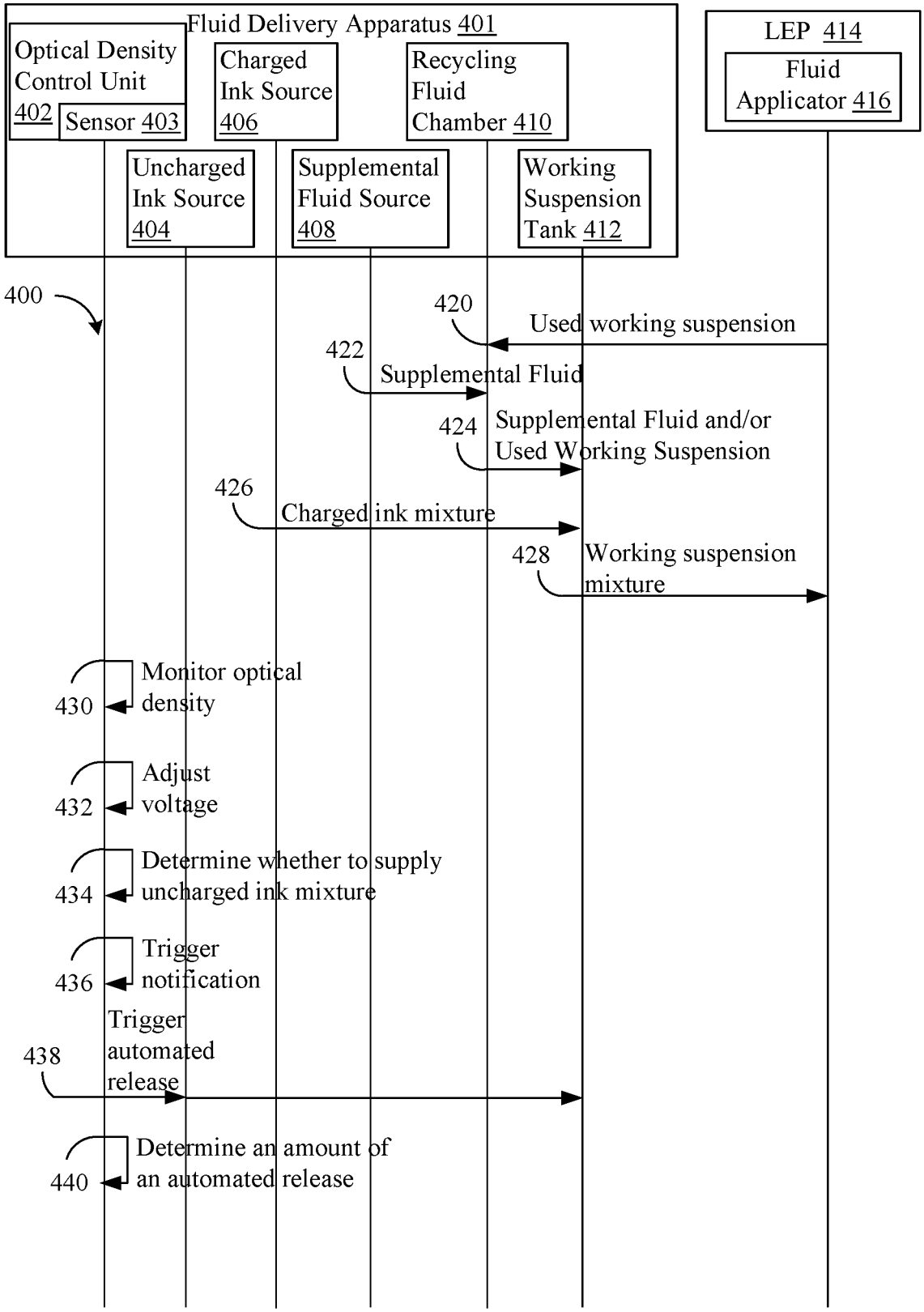
FIG. 4 is an illustration of a flowchart of a further example method for fluid delivery for liquid electrophotography printing according to an example.

FIG. 4 is a flowchart of an example of another method 400 for fluid delivery for liquid electrophotography printing according to an example. The method 400 may generally be implemented in a fluid delivery apparatus, such as, for example, the fluid delivery apparatus 101 (FIG. 1) and/or the fluid delivery apparatus 201 (FIG. 2), already discussed.

In an example, the method 400 (as well as method 300 (FIG. 3)) may be implemented in computer readable instructions (e.g., software), configurable computer readable instructions (e.g., firmware), fixed-functionality computer readable instructions (e.g., hardware), etc., or any combination thereof. While certain portions of a fluid delivery apparatus 401 are illustrated in method 400, other portions of the CPAP therapy management system 100 (FIG. 1) have been intentionally left out to simplify the explanation of the method.

In some examples, it will be appreciated that some or all of the operations in method 400 (as well as method 300 (FIG. 3)) may be performed at least in part by cloud processing.

It will be appreciated that some or all of the operations in method 400 (as well as method 300 (FIG. 3) and/or method 400 (FIG. 4)) are described using a "pull" architecture (e.g., polling for new information followed by a corresponding response) may instead be implemented using a "push" architecture (e.g., sending such information when there is new information to report), and vice versa.

With reference to both FIG. 1 and FIG. 2, illustrated processing block 420 provides for receiving a used working suspension. For example, a recycling fluid chamber 410 may receive a used working suspension from a liquid electrophotography printing apparatus 414.

Illustrated processing block 422 provides for storing a supplemental fluid and/or transferring the supplemental fluid. For example, a supplemental fluid source 408 is to store the supplemental fluid and/or transfer the supplemental fluid to the working suspension tank 412.

In some examples, the recycling fluid chamber 410 may receive the supplemental fluid from the supplemental fluid source 408 prior to the supplemental fluid being transferred to the working suspension tank 412.

In some implementations, the supplemental fluid comprises the imaging oil receiving a supplemental fluid.

Illustrated processing block 424 provides for passing the used working suspension and/or the supplemental fluid. For example, the recycling fluid chamber 410 is to receive the used working suspension from the liquid electrophotography printing apparatus 414, receive the supplemental fluid from the supplemental fluid source 408, and pass a mixture of the used working suspension and the supplemental fluid to the working suspension tank 412.

Illustrated processing block 426 provides for storing a charged ink mixture and/or transferring the charged ink mixture. For example, a charged ink source 406 is to store the charged ink mixture and/or transfer the charged ink mixture to the working suspension tank 412.

In some implementations, the charged ink mixture comprises the charge directors and the toner particles.

Illustrated processing block 428 provides for storing the working suspension mixture and/or transferring the working suspension mixture. For example, the working suspension tank 428 is in fluid communication with the charged ink source 406 and the supplemental fluid source 408 to receive the charge directors, the toner particles, and the imaging oil (e.g., which may be used in the working suspension mixture), store the working suspension mixture, and/or transfer the working suspension mixture to the LEP 414.

In some implementations, the working suspension mixture comprises charge directors, toner particles, imaging oil, the like, and/or combinations thereof.

Illustrated processing block 430 provides for monitoring an optical density. For example, an optical density of print output of the liquid electrophotography printing may be monitored.

Illustrated processing block 432 provides for determining whether to adjust a voltage to a fluid applicator. For example, the optical density control unit 402 is to determine whether to adjust a voltage to a fluid applicator 416 of the LEP 414 in response to the monitored optical density.

In some implementations, as the optical density is observed to decrease (e.g., past an optical density quality threshold), the optical density control unit 402 may increase the voltage to the fluid applicator 416 to increase the optical density to counteract the electrical fatigue.

In some examples, processing block 432 is performed in addition to processing blocks 434, 436, 438, and/or 440, as will be described below. In other examples, processing block 432 is omitted from method 400.

Illustrated processing block 434 provides for determining whether to supply an uncharged ink mixture to a working suspension mixture. For example, a determination may be made as to whether to supply an uncharged ink mixture to the working suspension mixture in response to the monitored optical density indicating electrical fatigue via the optical density control unit 402.

Illustrated processing block 436 provides for triggering a notification to a user. For example, the optical density control unit 402 is to trigger a notification to a user (e.g., via a display (not illustrated here)) in response to a determination to supply an uncharged ink mixture to the working suspension tank 412.

In some implementations, as the optical density is observed to decrease (e.g., past the optical density quality threshold), the optical density control unit 402 may trigger a notification to a user to supply uncharged ink to the working suspension tank. For example, an uncharged ink source 404 may be manually added to the fluid delivery apparatus 401 in response to such a notification.

In some examples, processing block 436 is performed in addition to processing blocks 432, 438, and/or 440, as will be described below. In other examples, processing block 436 is omitted from method 400.

Illustrated processing block 438 provides for triggering an automated release of the uncharged ink mixture. For example, the optical density control unit 402 is to trigger an automated release of the uncharged ink mixture from the uncharged ink source 404 in response to a determination to supply an uncharged ink mixture to the working suspension tank 412.

Additionally, or alternatively, the optical density control unit 402 is to trigger the automated release of the uncharged ink mixture in response to a determination that a further adjustment to increase the voltage to the fluid applicator 416 is not available.

In some implementations, as the optical density is observed to decrease (e.g., past the optical density quality threshold), the optical density control unit 402 may trigger an automated release of the uncharged ink mixture. For example, the uncharged ink source 404 may perform an automated release via a valve, a pump, the like, and/or combinations thereof.

In some implementations, the uncharged ink mixture is stored, via the uncharged ink source 404, which is in fluid communication with the working suspension tank 412.

In some examples, the uncharged ink mixture comprises additional toner particles free of association with additional charge directors.

In some examples, processing block 438 is performed in addition to processing blocks 432, 434, and/or 440, as will be described below. In other examples, processing block 438 is omitted from method 400.

Illustrated processing block 440 provides for determining an amount of the automated release. For example, the optical density control unit 402 is to determine an amount of the automated release of the uncharged ink mixture from the uncharged ink source 404 in response to the monitored optical density.

Figure 5:
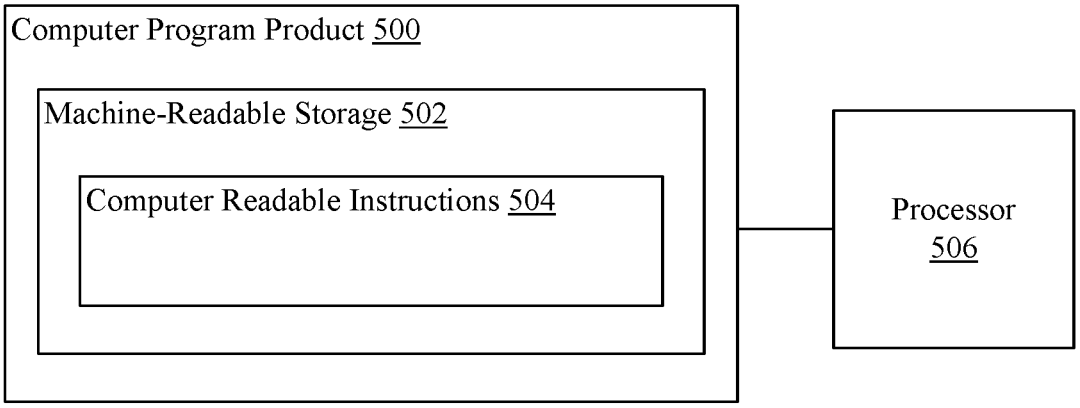
FIG. 5 is a block diagram illustrating a computer program product according to an example.

FIG. 5 illustrates a block diagram of an example computer program product 500. In some examples, as shown in FIG. 5, computer program product 500 includes a machine-readable storage 502 that may also include computer readable instructions 504. In some implementations, the machine-readable storage 502 may be implemented as a non-transitory machine-readable storage. In some implementations the computer readable instructions 504, which may be implemented as software, for example. In an example, the computer readable instructions 504, when executed by a processor 506, implement one or more aspects of the method 300 (FIG. 3), the method 400 (FIG. 4), the system 100 (FIG. 1), and/or the system 200 (FIG. 2), already discussed.

Figure 6:
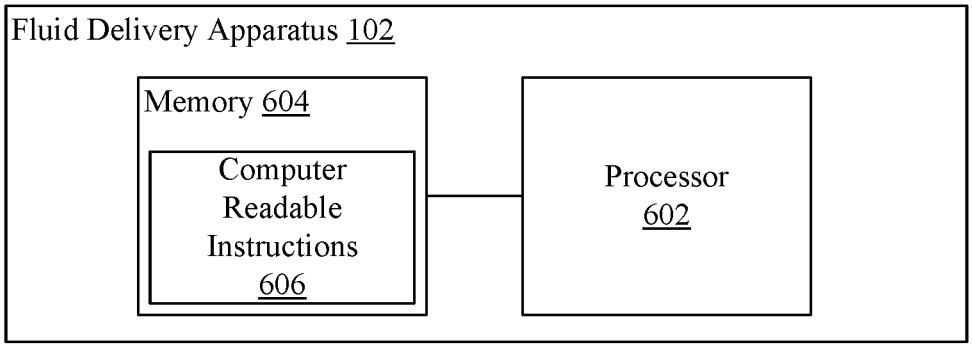
FIG. 6 is a block diagram illustrating an example fluid delivery apparatus according to an example.

FIG. 6 shows an illustrative example of the fluid delivery apparatus 102. In the illustrated example, the fluid delivery apparatus 102 may include a processor 602 and a memory 604 communicatively coupled to the processor 602. The memory 604 may include computer readable instructions 606, which may be implemented as software, for example. In an example, the computer readable instructions 606, when executed by the processor 602, implement one or more aspects of the method 300 (FIG. 3), the method 400 (FIG. 4), the system 100 (FIG. 1), and/or the system 200 (FIG. 2), already discussed.

In some implementations, the processor 602 may include a general purpose controller, a special purpose controller, a storage controller, a storage manager, a memory controller, a micro-controller, a general purpose processor, a special purpose processor, a central processor unit (CPU), the like, and/or combinations thereof.

Further, implementations may include distributed processing, component/object distributed processing, parallel processing, the like, and/or combinations thereof. For example, virtual computer system processing may implement one or more of the methods or functionalities as described herein, and the processor 602 described herein may be used to support such virtual processing.

In some examples, the memory 604 is an example of a computer-readable storage medium. For example, memory 604 may be any memory which is accessible to the processor 602, including, but not limited to RAM memory, registers, and register files, the like, and/or combinations thereof. References to "computer memory" or "memory" should be interpreted as possibly being multiple memories. The memory may for instance be multiple memories within the same computer system. The memory may also be multiple memories distributed amongst multiple computer systems or computing devices.

Figure 7:
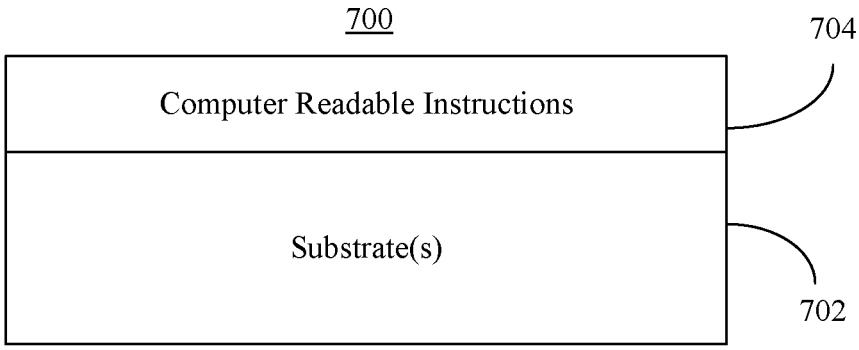
FIG. 7 is a block diagram illustrating a hardware apparatus including a semiconductor package according to an example.

FIG. 7 shows an illustrative semiconductor apparatus 700 (e.g., chip and/or package). The illustrated apparatus 700 includes one or more substrates 702 (e.g., silicon, sapphire, or gallium arsenide) and computer readable instructions 704 (such as, configurable computer readable instructions (e.g., firmware) and/or fixed-functionality computer readable instructions (e.g., hardware)) coupled to the substrate(s) 702. In an example, the computer readable instructions 704 implement one or more aspects of the method 300 (FIG. 3), the method 400 (FIG. 4), the system 100 (FIG. 1), and/or the system 200 (FIG. 2), already discussed.

In some implementations, computer readable instructions 704 may include transistor array and/or other integrated circuit/IC components. For example, configurable firmware logic and/or fixed-functionality hardware logic implementations of the computer readable instructions 704 may include configurable computer readable instructions such as, for example, programmable logic arrays (PLAs), field programmable gate arrays (FPGAs), complex programmable logic devices (CPLDs), or fixed-functionality computer readable instructions (e.g., hardware) using circuit technology such as, for example, application specific integrated circuit (ASIC), complementary metal oxide semiconductor (CMOS) or transistor-transistor logic (TTL) technology, the like, and/or combinations thereof.

As discussed above, some implementations described herein address electrical fatigue by adding uncharged ink to the existing working suspension in response to sensing low optical density. For example, in some examples, a refreshment of uncharged ink may be added to a fatigued working solution that includes charged ink during printing. In some examples, such uncharged ink may be added in response to a decline in optical density. For example, such uncharged ink may be added from a dedicated container and/or reservoir. Such a refreshment of uncharged ink to the fatigued working solution that includes charged ink is thought to stabilize the charging of the working solution and address the decline in optical density. Accordingly, some examples described herein may be implemented to avoid electrical fatigue in liquid electrophotography printing, such as during continuous printing of low coverage mono color, for example.

All definitions, as defined and used herein, should be understood to control over dictionary definitions, definitions in documents incorporated by reference, and/or ordinary meanings of the defined terms.

Furthermore, for ease of understanding, certain functional blocks may have been delineated as separate blocks; however, these separately delineated blocks should not necessarily be construed as being in the order in which they are discussed or otherwise presented herein. For example, some blocks may be able to be performed in an alternative ordering, simultaneously, etc.

Although a number of illustrative examples are described herein, it should be understood that numerous other modifications and examples can be devised by those skilled in the art that will fall within the spirit and scope of the principles of the foregoing disclosure. More particularly, reasonable variations and modifications are possible in the component parts and/or arrangements of the subject combination arrangement within the scope of the foregoing disclosure, the drawings and the appended claims without departing from the spirit of the foregoing disclosure. In addition to variations and modifications in the component parts and/or arrangements, alternative uses will also be apparent to those skilled in the art. The examples may be combined to form additional examples.

We claim:

1. A fluid delivery apparatus usable with a liquid electrophotography printing apparatus, the fluid delivery apparatus comprising:

a charged ink source to store a charged ink mixture, wherein the charged ink mixture comprises charge directors and toner particles;

a supplemental fluid source to store a supplemental fluid, wherein the supplemental fluid comprises imaging oil;

a working suspension tank in fluid communication with the charged ink source and the supplemental fluid source, the working suspension tank to store a working suspension mixture, wherein the working suspension mixture comprises the charge directors, the toner particles, and the imaging oil;

a sensor to monitor an optical density of print output of the liquid electrophotography printing apparatus; and an optical density control unit to determine whether to supply an uncharged ink mixture to the working suspension tank in response to the monitored optical density indicating electrical fatigue.

2. The fluid delivery apparatus of claim 1, further comprising:

an uncharged ink source in fluid communication with the working suspension tank, wherein the uncharged ink source is to store the uncharged ink mixture, wherein the uncharged ink mixture comprises additional toner particles free of association with additional charge directors.

3. The fluid delivery apparatus of claim 2, wherein the optical density control unit is to trigger an automated release of the uncharged ink mixture from the uncharged ink source in response to a determination to supply an uncharged ink mixture to the working suspension tank.

4. The fluid delivery apparatus of claim 3, wherein the optical density control unit is to determine an amount of the automated release of the uncharged ink mixture from the uncharged ink source in response to the monitored optical density.

5. The fluid delivery apparatus of claim 3, wherein the optical density control unit is to determine whether to adjust a voltage to a fluid applicator in response to the monitored optical density.

6. The fluid delivery apparatus of claim 5, wherein the optical density control unit is to trigger the automated release of the uncharged ink mixture in response to a determination that a further adjustment to increase the voltage to the fluid applicator is not available.

7. The fluid delivery apparatus of claim 1, wherein the optical density control unit is to trigger a notification to a user in response to a determination to supply an uncharged ink mixture to the working suspension tank.

8. The fluid delivery apparatus of claim 1, further comprising:

a recycling fluid chamber to receive a used working suspension from the liquid electrophotography printing apparatus, receive the supplemental fluid from the supplemental fluid source, and pass a mixture of the used working suspension and the supplemental fluid to the working suspension tank.

9. A system, comprising:

a liquid electrophotography printing apparatus; and a fluid delivery apparatus operatively associated with the liquid electrophotography printing apparatus, the fluid delivery apparatus comprising:

a charged ink source to store a charged ink mixture, wherein the charged ink mixture comprises charge directors and toner particles;

a supplemental fluid source to store a supplemental fluid, wherein the supplemental fluid comprises imaging oil;

a working suspension tank in fluid communication with the charged ink source and the supplemental fluid source, the working suspension tank to store a working suspension mixture, wherein the working suspension mixture comprises the charge directors, the toner particles, and the imaging oil;

a sensor to monitor an optical density of print output of the liquid electrophotography printing apparatus; and an optical density control unit to determine whether the monitored optical density indicates an electrical fatigue, and to cause a supply of an uncharged ink mixture to the working suspension tank in response to the monitored optical density indicating electrical fatigue.

10. The system of claim 9, the fluid delivery apparatus further comprising:

an uncharged ink source in fluid communication with the working suspension tank, wherein the uncharged ink source is to store the uncharged ink mixture, wherein the uncharged ink mixture comprises additional toner particles free of association with additional charge directors.

11. The system of claim 10, wherein the optical density control unit is to trigger an automated release of the uncharged ink mixture from the uncharged ink source in response to the monitored optical density indicating electrical fatigue.

12. The system of claim 11, wherein the optical density control unit is to determine an amount of the automated release of the uncharged ink mixture from the uncharged ink source in response to the monitored optical density.

13. The system of claim 11, wherein the optical density control unit is to determine whether to adjust a voltage to a fluid applicator in response to the monitored optical density.

14. The system of claim 13, wherein the optical density control unit is to trigger the automated release of the uncharged ink mixture in response to a determination that a further adjustment to increase the voltage to the fluid applicator is not available.

15. The system of claim 9, wherein the optical density control unit is to trigger a notification to a user in response to the monitored optical density indicating electrical fatigue.

16. A method of fluid delivery for liquid electrophotography printing, the method comprising:

monitoring an optical density of print output of the liquid electrophotography printing; and determining whether to supply an uncharged ink mixture to a working suspension mixture in response to the monitored optical density indicating electrical fatigue, wherein the working suspension mixture comprises charge directors, toner particles, and imaging oil.

17. The method of claim 16, further comprising:

storing, via a charged ink source, a charged ink mixture, wherein the charged ink mixture comprises the charge directors and the toner particles;

storing, via a supplemental fluid source, a supplemental fluid, wherein the supplemental fluid comprises the imaging oil;

storing, via a working suspension tank in fluid communication with the charged ink source and the supplemental fluid source, the working suspension mixture;

storing, via an uncharged ink source in fluid communication with the working suspension tank, the uncharged ink mixture, wherein the uncharged ink mixture comprises additional toner particles free of association with additional charge directors; and triggering an automated release of the uncharged ink mixture from the uncharged ink source in response to a determination to supply an uncharged ink mixture to the working suspension tank.

18. The method of claim 17, further comprising:

determining an amount of the automated release of the uncharged ink mixture from the uncharged ink source in response to the monitored optical density.

19. The method of claim 17, further comprising:

determining whether to adjust a voltage to a fluid applicator in response to the monitored optical density; and triggering the automated release of the uncharged ink mixture in response to a determination that a further adjustment to increase the voltage to the fluid applicator is not available.

20. The method of claim 16, further comprising:

triggering a notification to a user in response to a determination to supply an uncharged ink mixture to the working suspension tank.

* * * * *